US007765721B2

(12) United States Patent
Hentz, III et al.

(10) Patent No.: US 7,765,721 B2
(45) Date of Patent: Aug. 3, 2010

(54) ARTICLE OF FOOTWEAR HAVING REMOVABLE EYELET PORTION

(75) Inventors: Vernon J. Hentz, III, Tigard, OR (US); Lee Banks, Tigard, OR (US)

(73) Assignee: Nike, Inc., Beaverton, OR (US)

( * ) Notice: Subject to any disclaimer, the term of this patent is extended or adjusted under 35 U.S.C. 154(b) by 700 days.

(21) Appl. No.: 11/678,115

(22) Filed: Feb. 23, 2007

(65) Prior Publication Data

US 2008/0201986 A1 Aug. 28, 2008

(51) Int. Cl.
*A43B 11/00* (2006.01)
*A43C 11/00* (2006.01)

(52) U.S. Cl. ..... 36/50.1; 24/712.1

(58) Field of Classification Search ..... 36/50.1, 36/51, 93, 102, 54; 24/712.1, 71 SK, 712.6, 24/713.6

See application file for complete search history.

(56) References Cited

U.S. PATENT DOCUMENTS

| | | | | |
|---|---|---|---|---|
| 2,321,754 | A | 6/1943 | Koehler | |
| 3,931,686 | A * | 1/1976 | Rathbun | 36/51 |
| 4,079,527 | A | 3/1978 | Antonious | |
| 4,081,916 | A | 4/1978 | Salisbury | |
| 4,215,493 | A | 8/1980 | Antonious | |
| 4,414,761 | A | 11/1983 | Mahood | |
| 4,628,622 | A | 12/1986 | McBarron | |
| 5,027,482 | A | 7/1991 | Torppey | |
| 5,042,119 | A * | 8/1991 | Williams | 24/712.3 |
| D337,425 | S | 7/1993 | Hatfield | |
| 5,349,764 | A | 9/1994 | Posner | |
| 5,353,483 | A | 10/1994 | Louviere | |
| 5,357,691 | A | 10/1994 | Hyde et al. | |
| 5,511,325 | A | 4/1996 | Hieblinger | |
| 5,755,044 | A | 5/1998 | Veylupek | |
| 5,907,912 | A | 6/1999 | Alaimo | |
| 6,199,305 | B1 * | 3/2001 | Steuerwald et al. | 36/50.1 |
| 6,757,991 | B2 | 7/2004 | Sussmann | |
| 6,941,683 | B2 | 9/2005 | Freed | |
| 6,968,638 | B2 * | 11/2005 | Gonzalez Palacio | 36/112 |
| 7,487,603 | B2 * | 2/2009 | Davis et al. | 36/50.1 |
| 2005/0081403 | A1 * | 4/2005 | Mathieu | 36/50.1 |
| 2006/0053658 | A1 * | 3/2006 | Voughlohn | 36/50.1 |

* cited by examiner

*Primary Examiner*—Jila M Mohandesi
(74) *Attorney, Agent, or Firm*—Plumsea Law Group, LLC

(57) ABSTRACT

An article of footwear is configured so that a child or other wearer may easily insert his or her foot into the article of footwear without tying laces while maintaining the look of a laced article of footwear. A lateral portion of the eyelet region partially surrounding the vamp is removably attached to the upper, such as with a hook-and-loop system, to allow the width of the vamp to be manipulated. The medial portion of the eyelet region is fixedly attached to the upper so that the rubbing together of the medial sides of the feet to not unintentionally disengage the medial portion from the upper. The lateral portion of the eyelet region rotates on a hinge formed in the eyelet region. Laces are fixedly attached to the eyelet region. A gore strap is optionally provided for more secure wear.

19 Claims, 4 Drawing Sheets

ARTICLE OF FOOTWEAR HAVING REMOVABLE EYELET PORTION

BACKGROUND OF THE INVENTION

1. Field of the Invention

The present invention relates generally to an article of footwear. More particularly, the invention relates to an article of footwear having a removable eyelet portion for fast entry and egress.

2. Description of Related Art

Shoes, particularly athletic shoes, are typically fastened with laces. Laces have long been employed as a relatively simple way in which the width of the shoe may be adjusted, such as by tightening the laces to decrease the width of the shoe or loosening the laces to increase the width of the shoe. This adjustability allows a wearer to slightly customize the shoe for maximum comfort.

Furthermore, laces provide a specific aesthetic appearance for a shoe. Different materials, different colors, and even different lacing configurations through the eyelets allow for customization of the look of a shoe, even a popular shoe.

However, laces are sometimes difficult for a wearer to use, especially if the wearer is a child, arthritic, or otherwise unable to bend easily to reach and manipulate the laces. Children, especially small children, are typically unable to tie their own laces, and tying the small laces provided with children's shoes may prove challenging for the larger fingers of an adult. Additionally, laces loosen and untie over time. This presents a hazard for children unable to re-tie their shoes.

Many shoes have been developed to free children and other people unable or unwilling to handle laces. In some cases, shoes have been developed which eliminate laces or lace-like structures entirely. For example, shoes having only hook-and-loop fastening systems, such as Velcro®, have become very popular for children's and orthotic shoes. While providing the wearer the ability to manipulate the shoe's opening and closing relatively easily, such shoes lack the aesthetic appearance and appeal of shoes with laces. Furthermore, such shoes could be challenging to tighten sufficiently on a foot, as the force needed to pull the hook portion and the eye portion together can prove difficult for a wearer, such as a child or an arthritic adult, to attain.

Several shoes have been developed that combine fastening systems. For example, U.S. Pat. Nos. 4,414,761 and 5,027,482 describe shoes with two fastening systems: laces and a hook-and-loop system incorporated into the eyelet region. In these shoes, the laces are tied or otherwise manipulated to adjust the width of the vamp. In the '761 reference, the laces are tied to produce the desired width. In the '482 reference, the laces are pulled then secured by the hook-and-loop system to produce the desired width. The hook-and-loop mechanism is incorporated with the laces so that the eyelet region or a portion thereof may be lifted to manipulate the vamp without adjusting or readjusting the laces. However, in these references, the removable portion of the eyelet region is rotated on the laces. This rotation increases wear on the laces and early breakage. U.S. Pat. No. 5,907,912 describes a similar dual fastening system, although the removable portion of the eyelet region is rotated on a second portion of the eyelet region. However, in the '912 reference, as in the '761 reference, the laces are tied to adjust the width of the vamp. This type of dual system still necessitates tying and re-tying the laces as they loosen over time.

Therefore, there exists a need in the art for an article of footwear which does not require the manipulation of a lace or laces to secure the article of footwear on the foot but which retains the look of a laced shoe.

SUMMARY OF THE INVENTION

In one aspect, the invention provides an article of footwear comprising an upper configured to receive a foot, a sole attached to the upper, a throat formed in the upper, an adjustable opening formed in the upper and connected to the throat, an eyelet region at least partially surrounding the adjustable opening, a plurality of eyelet holes formed in the eyelet region, a lace threaded through the eyelet holes and fixed into position, a lateral side of the eyelet region being removably attached to the upper with a securing mechanism, a medial side of the eyelet region being fixedly attached to the upper, and a hinge formed in the eyelet region about which the lateral side rotates during separation from the upper.

In another aspect, the hinge is formed with a stitch.

In another aspect, the lateral side of the eyelet region has a shape that mirrors a medial side shape of the eyelet region.

In another aspect, a tongue is positioned beneath the adjustable opening.

In another aspect, the lace is made from an elastic material.

In another aspect, the lace is made from an inelastic material.

In another aspect, a gore strap is provided, a lateral side of the gore strap being attached to a lateral side of the adjustable opening and a medial side of the gore strap being attached to a medial side of the adjustable opening.

In another aspect, the gore strap is made of an elastic material.

In another aspect, the lateral side of the eyelet region is formed of an elongated portion of material with a pull tab formed at a first end of the elongated portion of material and the hinge connecting a second end of the elongated portion of material to the upper.

In another aspect, the securing mechanism includes a hook-and-loop system, with a first surface of a hook-and-loop closure system fixedly attached to the upper, a second surface of the hook-and-loop closure system fixedly attached to the lateral side of the eyelet region, and the first surface and the second surface positioned to engage when the lateral side of the eyelet region contacts the upper.

In another aspect, the lace fixed into position with a stitch connecting the lace to the eyelet region.

In another aspect, the lace is fixed into position with an adhesive connecting the lace to the eyelet region.

In another aspect, the invention provides a fastening system for adjusting a vamp in an upper of an article of footwear comprising an eyelet region at least partially surrounding the vamp, a lateral side of the eyelet region being removably attached to the upper with a securing mechanism, a medial side of the eyelet region being fixedly attached to the upper, a lace fixedly attached to the eyelet region, and a hinge formed in the eyelet region about which the lateral side of the eyelet region rotates during separation from the upper.

In another aspect, the securing mechanism comprises a hook-and-loop system, a first surface of a hook-and-loop closure system fixedly attached to the upper, a second surface of the hook-and-loop closure system fixedly attached to the lateral side of the eyelet region, and the first surface and the second surface positioned to engage when the lateral side of the eyelet region contacts the upper.

In another aspect, a plurality of eyelet holes is formed in the eyelet region, the plurality of eyelet holes configured to receive the lace.

In another aspect, the lace is threaded through the eyelet holes in a criss-cross pattern.

In another aspect, the hinge is formed from a stitch.

In another aspect, the article of footwear comprises an athletic shoe.

In another aspect, the article of footwear comprises a child's shoe.

In another aspect, the article of footwear comprises an orthotic shoe.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

FIGS. 1-6 show a preferred embodiment of an article of footwear 100 according to the invention having a quickly adjustable upper 102. In this embodiment, article of footwear 100 is generally fashioned as a child's athletic shoe or an orthotic shoe, having an upper 102 fixedly attached to a sole 104, such as with an adhesive. In other embodiments, article of footwear 100 may be a different type of shoe, a sandal, or the like. Upper 102 is preferably made from leather or synthetic leather-like fabrics, but in other embodiments, upper 102 may be made from any type of material known in the art, such as canvas and other synthetic woven and non-woven fabrics. Upper 102 may also include multiple layers of material. Sole 104 may be any type of sole known in the art, but is preferably a multi-layer sole including an insole, cushioning midsole, and ground-engaging outsole. In the figures, only the outsole is shown. Upper 102 may be made using any method known in the art, such as by stretching material over a last and joining the pieces together by stitching, with an adhesive, or via any other method known in the art.

Figure 1:
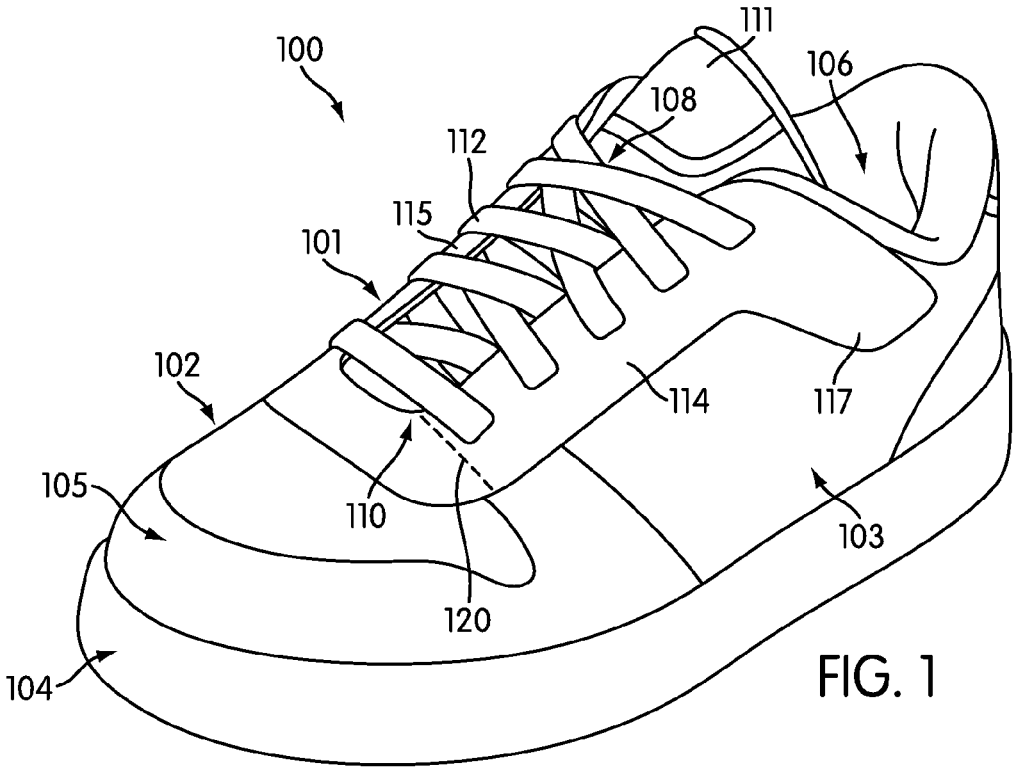
FIG. 1 is a schematic perspective view of an article of footwear according to the present invention.
Figure 2:
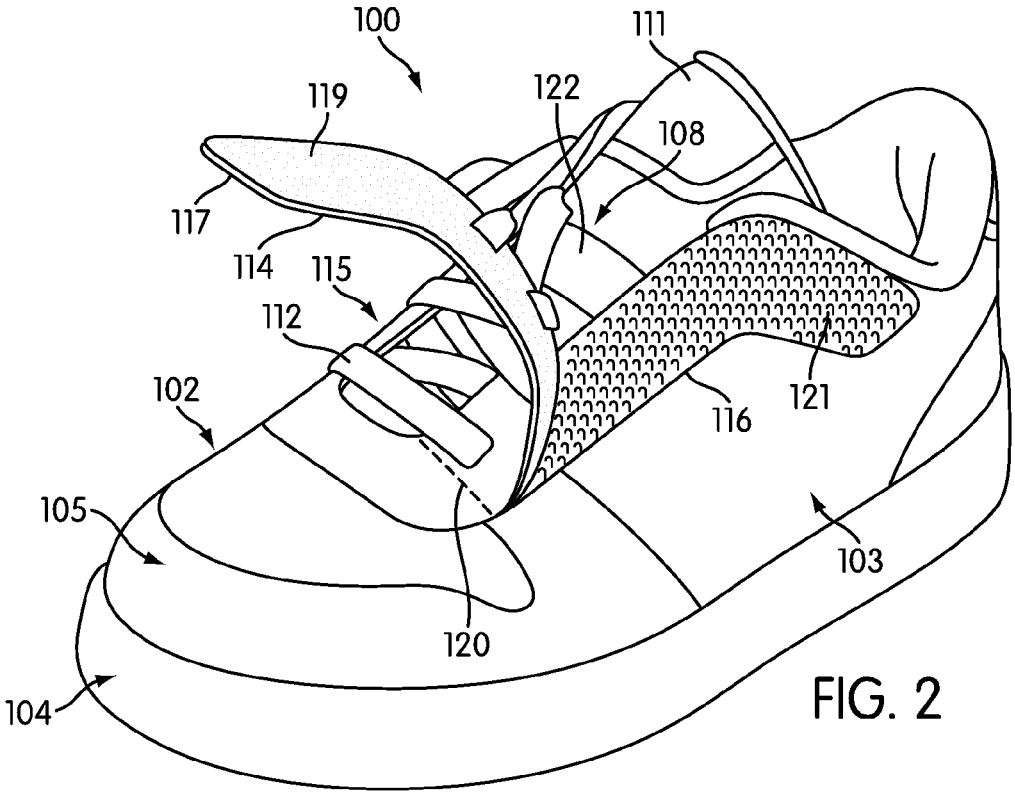
FIG. 2 is a schematic perspective view of the article of footwear of FIG. 1 with a portion of the eyelet region in an open configuration.

Upper 102 is configured generally with a throat 106 that connects to a vamp or adjustable opening 108. In this embodiment, adjustable opening 108 extends away from throat 106 toward a toe region 105 approximately centrally on upper 102. In other embodiments, however, adjustable opening 108 may be positioned on a lateral side 103 or on a medial side 101 of upper 102. Adjustable opening 108 allows upper 102 to be tightened or loosened around the foot of a wearer. For example, adjustable opening 108 may be loosened to open upper 102 in order to allow a wearer to insert his or her foot more easily into throat 106 or to slightly expand the width of upper 102 for a more comfortable fit. Similarly, adjustable opening 108 may be tightened to close upper 102 in order to prevent the foot from unintentionally being extracted from upper 102 or to slightly decrease the width of upper 102 for a more comfortable fit. FIG. 1 shows article of footwear 100 with upper 102 in a closed configuration, and FIG. 2 shows article of footwear 100 with upper 102 in an open configuration.

Figure 6:
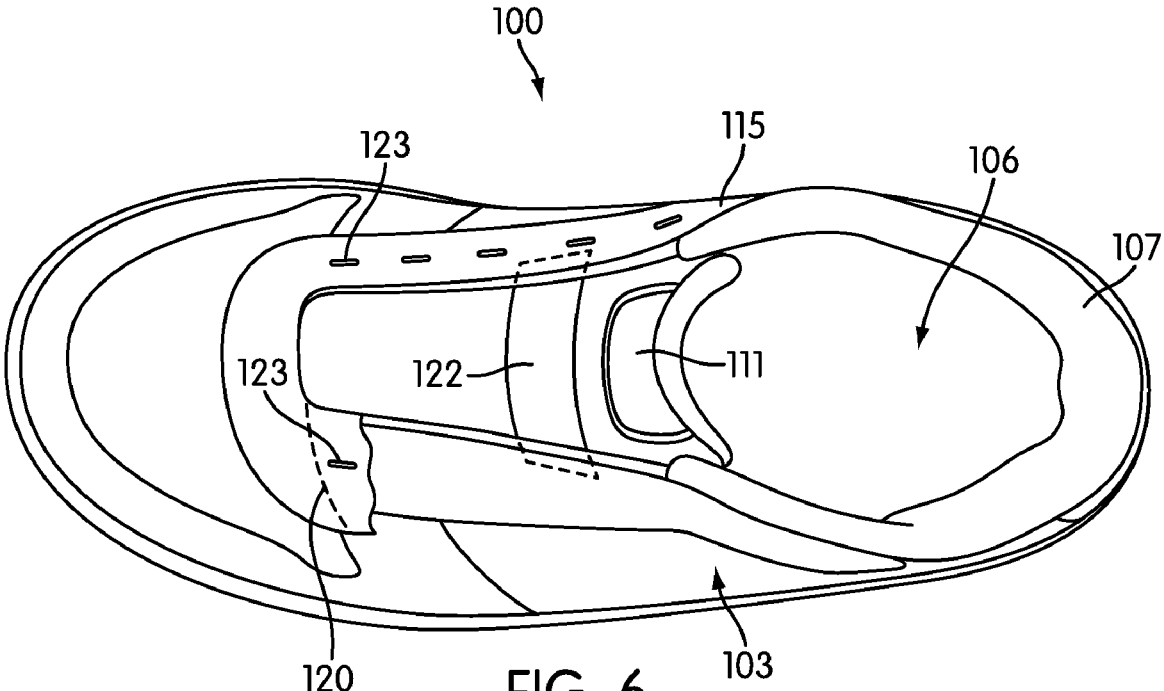
FIG. 6 is a schematic cut away top view of the article of footwear of FIG. 2, showing a gore strap and eyelet holes.

To alter the width of adjustable opening 108 and to secure adjustable opening 108 in position once a desired width has been achieved, adjustable opening 108 is provided with an eyelet region 110. Eyelet region 110 extends around adjustable opening 108 to partially surround adjustable opening 108. Eyelet region 110, which is preferably formed from a portion of the same or similar material as upper 102, includes a lateral portion 114 and a medial portion 115. As shown in FIG. 6, eyelet region 110 also includes a plurality of eyelet holes 123 through which a lace 112 is threaded. While ten eyelet holes 123 are provided in this embodiment, five on each side of adjustable opening 108, any number of eyelet holes 123 may be provided in other embodiments. For example, another embodiment may have no eyelet holes 123 if lace 112 is affixed to eyelet region 110 with an adhesive.

Figure 3:
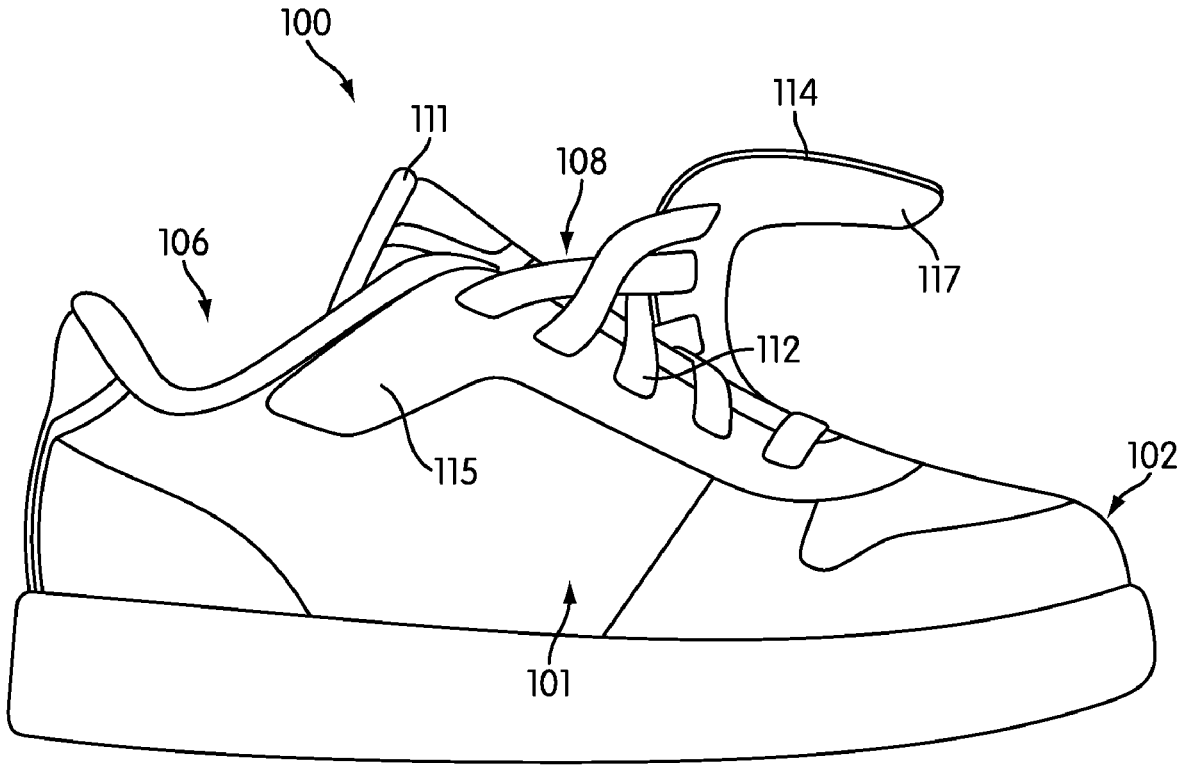
FIG. 3 is a schematic medial side view of the article of footwear of FIG. 2.

Lateral portion 114 is separably attached to upper 102 to allow for the manipulation of adjustable opening 108. Lateral portion 114 may be peeled or pulled away from upper 102, as shown in FIG. 2, by pivoting lateral portion 114 about a hinge 120. However, medial portion 115 is fixedly attached to upper 102, as is best shown in FIG. 3. Only lateral portion 114 of eyelet region 110 is separable from upper 102 for enhanced stability. As a person walks or runs, his or her feet may accidentally rub together on the medial side of the foot or article of footwear. This accidental rubbing together of the medial sides of the feet is especially common in children who do not have the same degree of control over their appendages as do adults. If medial portion 115 were also separable from upper 102, then this rubbing together of the medial sides of the feet may cause medial portion 115 to separate from upper 102 unintentionally. Similar to an untied lace, this unintentional separation could result in the wearer tripping and falling due to an overly loose article of footwear, perhaps resulting in injury. Therefore, medial portion 115 is fixed to upper 102 in a non-removable manner while lateral portion 114 is separably attached to upper 102. Medial portion 115 may be attached to upper 102 by any method known in the art, such as by stitching or with an adhesive. In another embodiment, medial portion 115 is formed integrally with upper 102 so that only lateral portion 114 is formed with a separate piece of material. In such an embodiment, medial portion 115 may optionally be outlined by stitching, printing, or other decorative elements.

Preferably, the shape of lateral portion 114 mirrors the shape of medial portion 115 so that when lateral portion 114 is attached to upper 102, eyelet region 110 has the appearance of a single, continuous symmetrical region. In other embodiments, lateral portion 114 does not mirror medial portion 115 so that eyelet region 110 may have an asymmetrical or discontinuous appearance. Preferably, lateral portion 114 is formed from an elongated piece of material which extends from hinge 120 to a pull tab 117. Positioned at the free end of lateral portion 114, pull tab 117 is a slightly wider portion of material angled away from the elongated body of lateral portion 114 to allow a user to more easily grasp lateral portion 114 for manipulation, such as to separate lateral portion 114 from upper 102.

Lateral portion 114 is attached to upper 102 with a reusable closure system, preferably with a hook-and-loop closure system such as Velcro®. However, lateral portion 114 may be attached to upper 102 via any method known in the art, such as with snaps, a zipper, or a similar reusable closure system. A first portion 119 of the closure system is fixedly attached to the side of lateral portion 114 of eyelet region 110 facing upper 102, such as with stitches or an adhesive. Preferably, first portion 119 covers or substantially covers the side of lateral portion 114 of eyelet region 110 facing upper 102. A corresponding second portion 121 of the closure system is fixedly attached to upper 102 in a region 116 on lateral side 103, such as with stitches or with an adhesive. Region 116 preferably has the same or substantially the same shape as lateral portion 114, although in other embodiments region 116 may be smaller or larger than lateral portion 114. First portion 119 and second portion 121 are configured to engage with each other to secure lateral portion 114 to upper 102 when first portion 119 and second portion 121 are pressed together, such as with the fingers of the wearer.

In the embodiment shown in FIGS. 1-6, lace 112 is preferably a single lace threaded through eyelet holes 123 to form a criss-cross pattern across adjustable opening 108. However, in other embodiments, multiple laces may be provided, or the lace(s) may be threaded through eyelet holes 123 in any type of configuration or pattern. Lace 112 is preferably made from an elastic or other slightly stretchy material, although in other embodiments lace 112 may be made from a fixed length material, such as woven cotton or leather. Lace 112 is preferably fixed into position, such as with stitches or an adhesive, as lace 112 is not tied, pulled, or otherwise adjusted by the user in order to manipulate the size of adjustable opening 108. Lace 112 may be affixed within each eyelet hole 123 or may be affixed at selected locations.

Figure 4:
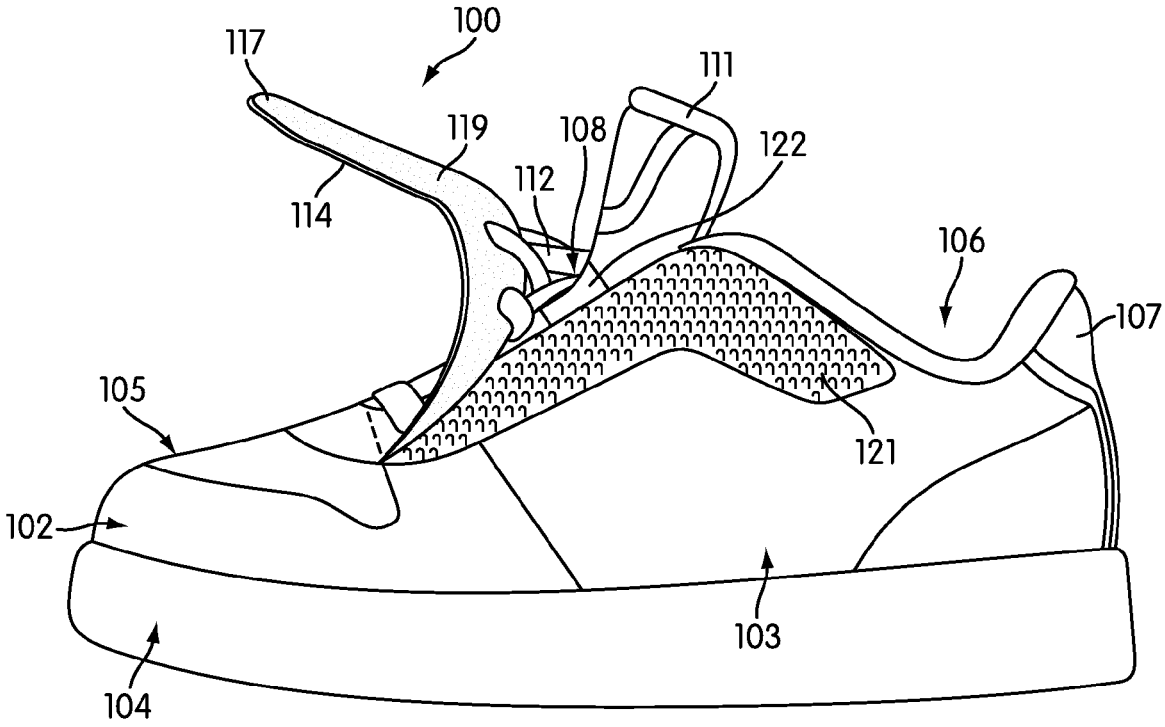
FIG. 4 is a schematic lateral side view of the article of footwear of FIG. 1 with a portion of the eyelet region in an open configuration and with a tongue arranged for foot insertion.

A tongue 111 is preferably provided below adjustable opening 108 and extending out of throat 106 to close the gap in upper 102. Tongue 111 may also be used to manipulate adjustable opening 108, such as by grasping tongue 111 and pulling to loosen adjustable opening 108, as shown in FIG. 4.

For additional comfort while wearing article of footwear 100, preferably a gore strap 122 is provided, as shown in FIG. 6. Gore strap 122 is fixedly attached to medial side 101 and to lateral side 103 so that gore strap 122 extends across adjustable opening 108. Preferably, gore strap 122 is attached at or near the point at which adjustable opening 108 transitions to throat 106. Preferably, gore strap 122 is made from an elastic material or an elastic material covered with another material so that gore strap 122 may be slightly stretched for ease of foot insertion. Gore strap 122 is used to more securely hold the wearer's foot within article of footwear so that the foot is not accidentally or unintentionally extracted from article of footwear 100 while walking or running.

Figure 5:
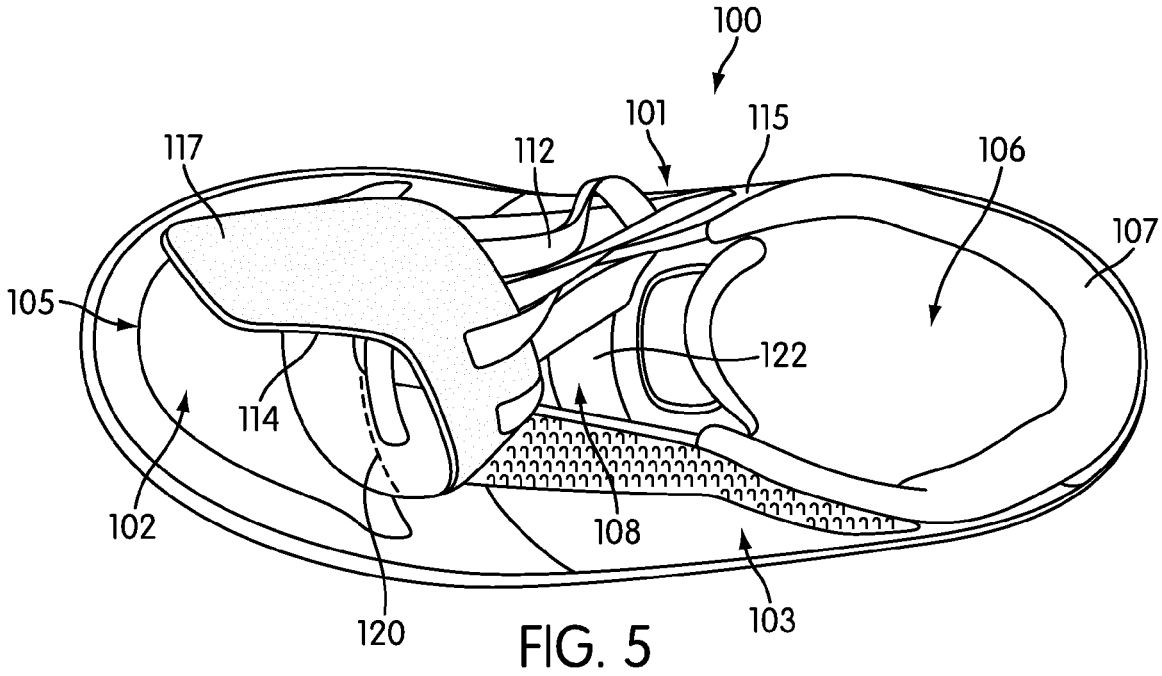
FIG. 5 is a schematic top view of the article of footwear of FIG. 2.

To put on article of footwear 100, pull tab 117 is grasped and lateral portion 114 is separated from upper 102, such as by pulling lateral portion 114 to peel first portion 119 from second portion 121. Lateral portion 114 is rotated on hinge 120, lifted away from upper 102, and optionally folded across upper 102 as shown in FIG. 5. Lace 112 is also lifted away from upper 102 to prevent entanglement with the foot during insertion. Adjustable opening 108 may be further loosened by pulling tongue 111 toward toe region 105, as shown in FIG. 4. A wearer's foot is then inserted into throat 106 and underneath gore strap 122. Gore strap 122 may be pulled with the fingers to extend its length temporarily for ease of foot insertion, or the foot itself may temporarily lengthen gore strap 122 to allow the foot to be inserted into upper 102.

After foot insertion, upper 102 is then tightened around the foot for secure wearing. To secure upper 102 on the foot, tongue 111 is optionally pulled into position under adjustable opening 108. Lateral portion 114 is rotated on hinge 120 to draw medial side 101 of upper 102 towards lateral side 103 of upper 102. The movement of lateral portion 114 positions lace 112 into the desired arrangement across adjustable opening 108. Lateral portion 114 is then aligned with region 116 so that first portion 119 and second portion 121 are aligned. First portion 119 is pressed against second portion 121 until first portion 119 engages second portion 121. As shown in FIG. 1, upon fastening lateral portion 114 to upper 102, article of footwear 100 preferably has the appearance of an article of footwear secured with tied laces. In other words, the portions 119, 121 of the securing mechanism are preferably hidden from view when lateral portion 114 is attached to upper 102 correctly.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising: an upper configured to receive a foot; a sole attached to the upper; a throat formed in the upper;

an adjustable opening formed in the upper and connected to the throat; an eyelet region at least partially surrounding the adjustable opening; a plurality of eyelet holes formed in the eyelet region;

a lace threaded through the eyelet holes and fixed into position such that the lace is nonremovable from the article of footwear;

a lateral side of the eyelet region being removably attached to the upper with a securing mechanism;

a medial side of the eyelet region being fixedly attached to the upper; and a hinge formed in the eyelet region about which the lateral side rotates during separation from the upper; wherein said hinge is formed at an end portion of the lateral side farthest from the throat opening and extending, generally in a lateral direction, the lateral direction being from a lateral side of the article of footwear to a medial side of the article of footwear.

2. The article of footwear according to claim 1, the lateral side of the eyelet region having a shape that mirrors a medial side shape of the eyelet region, the eyelet region comprising a continuous piece of material from the lateral side to the medial side.

3. The article of footwear according to claim 1, further comprising a tongue positioned beneath the adjustable opening.

4. The article of footwear according to claim 1, the lace being made from an elastic material.

5. The article of footwear according to claim 1, the lace being made from an inelastic material.

6. The article of footwear according to claim 1, further comprising a gore strap, a lateral side of the gore strap being attached to a lateral side of the adjustable opening and a medial side of the gore strap being attached to a medial side of the adjustable opening.

7. The article of footwear according to claim 6, the gore strap being made of an elastic material.

8. The article of footwear according to claim 1, the lateral side of the eyelet region formed of an elongated portion of material with a pull tab formed at a first end of the elongated portion of material and the hinge connecting a second end of the elongated portion of material to the upper.

9. The article of footwear according to claim 1, the securing mechanism comprising a hook-and-loop system, with a first surface of a hook-and-loop closure system fixedly attached to the upper;

a second surface of the hook-and-loop closure system fixedly attached to the lateral side of the eyelet region; and the first surface and the second surface positioned to engage when the lateral side of the eyelet region contacts the upper.

10. The article of footwear according to claim 1, the lace fixed into position with a stitch connecting the lace to the eyelet region, the lace comprising a plurality of longitudinal portions each spanning between a first eyelet of the lateral side of the eyelet region and a second eyelet of the medial side of the eyelet region, each longitudinal portion of the lace being continuous between the first eyelet and the second eyelet.

11. The article of footwear according to claim 1, the lace fixed into position with an adhesive connecting the lace to the eyelet region, the lace comprising a continuous length of material having a first end and a second end, the first end and the second end being fixed to the eyelet region.

12. A fastening system for adjusting a vamp in an upper of an article of footwear comprising:

an eyelet region at least partially surrounding the vamp;

a lateral side of the eyelet region being removably attached to the upper with a securing mechanism;

a medial side of the eyelet region being fixedly attached to the upper; a lace fixedly attached to the eyelet region; and a hinge formed in the eyelet region about which the lateral side of the eyelet region rotates during separation from the upper, the hinge formed at an end portion of the lateral side farthest from a throat opening in the upper and extending, generally in a lateral direction, the lateral direction being from a lateral side of the article of footwear to a medial side of the article of footwear.

13. The fastening system according to claim 12, the securing mechanism comprising a hook-and-loop system;

a first surface of a hook-and-loop closure system fixedly attached to the upper;

a second surface of the hook-and-loop closure system fixedly attached to the lateral side of the eyelet region; and the first surface and the second surface positioned to engage when the lateral side of the eyelet region contacts the upper.

14. The fastening system according to claim 12, a plurality of eyelet holes formed in the eyelet region, the plurality of eyelet holes configured to receive the lace.

15. The fastening system according to claim 14, the lace being threaded through the eyelet holes in a criss-cross pattern.

16. The fastening system according to claim 12, the hinge formed from a line of stitching extending in the lateral direction.

17. The fastening system according to claim 12, the hinge comprising a line of stitching through the end portion of the lateral side of the eyelet region, the line of stitching extending in the lateral direction and attaching the end portion of the lateral side to the upper, the lateral side of the eyelet region rotating around the line of stitching, and the eyelet region having material spanning between the lateral side and the medial side.

18. The fastening system according to claim 12, the eyelet region comprising a continuous piece of material from the lateral side to the medial side.

19. The fastening system according to claim 12, the lace being nonremovable from the article of footwear.

* * * * *